US009502824B2

(12) United States Patent
Jordan

(10) Patent No.: US 9,502,824 B2
(45) Date of Patent: Nov. 22, 2016

(54) ELECTRICAL CONNECTOR

(71) Applicant: ITT MANUFACTURING ENTERPRISES, LLC, Wilmington, DE (US)

(72) Inventor: Peter Jordan, Basingstoke (GB)

(73) Assignee: ITT MANUFACTURING ENTERPRISES, LLC, Wilmington, DE (US)

( * ) Notice: Subject to any disclaimer, the term of this patent is extended or adjusted under 35 U.S.C. 154(b) by 0 days.

(21) Appl. No.: 14/718,992

(22) Filed: May 21, 2015

(65) Prior Publication Data

US 2015/0340805 A1 Nov. 26, 2015

(30) Foreign Application Priority Data

May 23, 2014 (GB) ..... 1409239.9

(51) Int. Cl.

| | |
|---|---|
| ***H01R 13/629*** | (2006.01) |
| ***H01R 13/622*** | (2006.01) |
| ***H01R 13/639*** | (2006.01) |
| ***H01R 13/645*** | (2006.01) |
| *H01R 13/627* | (2006.01) |

(52) U.S. Cl.

CPC ..... *H01R 13/629* (2013.01); *H01R 13/622* (2013.01); *H01R 13/639* (2013.01); *H01R 13/6456* (2013.01); *H01R 13/6277* (2013.01)

(58) Field of Classification Search

CPC H01R 13/622; H01R 9/0524; H01R 9/0521; H01R 9/05; H01R 12/772; H01R 13/53; H01R 13/5845; H01R 13/60; H01R 13/6273; H01R 31/06; H01R 39/643; H01R 43/20

See application file for complete search history.

(56) References Cited

U.S. PATENT DOCUMENTS

| | | | |
|---|---|---|---|
| 467,546 | A | 1/1892 | Mailloux |
| 2,761,111 | A | 8/1956 | Klostermann |

(Continued)

FOREIGN PATENT DOCUMENTS

| | | | |
|---|---|---|---|
| AT | 225986 | B | 2/1963 |
| AU | 199728400 | A | 7/1997 |

(Continued)

OTHER PUBLICATIONS

Extended European Search Report in corresponding European Patent Application No. 15168498.2, dated Oct. 30, 2015.

*Primary Examiner* — Truc Nguyen

(74) *Attorney, Agent, or Firm* — Knobbe, Martens, Olson & Bear LLP

(57) ABSTRACT

An electrical connector for terminating an electrical cable and for engaging with a mating electrical connector comprises a body, resilient member, and a collar. The body has an engagement portion including a sleeve which extends in a longitudinal direction for engaging with the mating electrical connector. The sleeve comprises a keyway configured to receive a keyed mating connector. The resilient member is arranged on the sleeve and can deform in a transverse direction perpendicular to the direction and provide a reaction force for maintaining the engagement of the connector with the mating connector. The collar is configured to rotate about the sleeve, and comprises a radially inwardly protruding pin which extends into the sleeve and can be moved between two positions. One position is within the keyway between the key of the mating connector and the keyway opening such that the pin prevents axial disengagement of the connector.

20 Claims, 10 Drawing Sheets

(56) References Cited

U.S. PATENT DOCUMENTS

| | | | | |
|---|---|---|---|---|
| 3,287,031 | A | 11/1966 | Simmons et al. | |
| 3,295,868 | A | 1/1967 | Georges | |
| 4,090,759 | A * | 5/1978 | Herrmann, Jr. | H01R 13/53 439/279 |
| 4,531,801 | A | 7/1985 | Baur | |
| 4,673,234 | A * | 6/1987 | Lewis | H01R 13/565 439/323 |
| 4,929,188 | A | 5/1990 | Lionetto et al. | |
| 5,067,909 | A | 11/1991 | Behning | |
| 5,167,522 | A | 12/1992 | Behning | |
| 5,372,517 | A | 12/1994 | Levesque | |
| 5,590,228 | A | 12/1996 | Gibola et al. | |
| 5,662,488 | A | 9/1997 | Alden | |
| 5,882,226 | A | 3/1999 | Bell et al. | |
| 6,162,082 | A | 12/2000 | Karsten | |
| 6,226,068 | B1 | 5/2001 | Arcykiewicz et al. | |
| 6,290,525 | B1 | 9/2001 | Jacobi et al. | |
| 6,336,822 | B1 | 1/2002 | Luzzoli | |
| 6,561,841 | B2 | 5/2003 | Norwood et al. | |
| 6,634,897 | B2 | 10/2003 | Cykon et al. | |
| 6,716,048 | B2 | 4/2004 | Collin et al. | |
| 6,776,638 | B2 | 8/2004 | Thurston | |
| 6,875,037 | B2 | 4/2005 | Collin et al. | |
| 6,921,283 | B2 | 7/2005 | Zahlit et al. | |
| 7,074,066 | B2 | 7/2006 | Pepe | |
| 7,081,001 | B1 | 7/2006 | Conroy et al. | |
| 7,086,886 | B2 | 8/2006 | Thurston | |
| 7,104,826 | B2 | 9/2006 | Zahlit et al. | |
| 7,153,153 | B1 | 12/2006 | Conroy et al. | |
| 7,274,964 | B2 | 9/2007 | Balsells | |
| 7,326,091 | B2 | 2/2008 | Nania et al. | |
| 7,338,305 | B2 | 3/2008 | Norwood et al. | |
| 7,347,726 | B2 | 3/2008 | Wlos | |
| 7,347,727 | B2 | 3/2008 | Wlos et al. | |
| 7,367,833 | B2 | 5/2008 | Matsumoto | |
| 7,455,542 | B2 | 11/2008 | Norwood et al. | |
| 7,621,786 | B2 | 11/2009 | Yavari et al. | |
| 7,661,995 | B2 | 2/2010 | Nania et al. | |
| 7,726,999 | B2 | 6/2010 | Vanzo | |
| 7,758,389 | B2 * | 7/2010 | Kadar-Kallen | G02B 6/389 439/660 |
| 7,780,486 | B2 | 8/2010 | Yavari et al. | |
| 8,166,623 | B2 | 5/2012 | Balsells | |
| 8,171,629 | B2 * | 5/2012 | Blew | H01R 9/0521 29/402.01 |
| 8,177,575 | B2 | 5/2012 | Katagiyama et al. | |
| 8,246,392 | B2 | 8/2012 | Amidon | |
| 8,297,662 | B2 | 10/2012 | Balsells | |
| 8,375,543 | B1 | 2/2013 | Balsells | |
| 8,491,345 | B2 | 7/2013 | Leon et al. | |
| 8,496,494 | B2 | 7/2013 | Jordan | |
| 8,561,274 | B2 | 10/2013 | Balsells | |
| 8,628,252 | B2 | 1/2014 | Matsumoto et al. | |
| 8,757,915 | B2 * | 6/2014 | Sugimoto | G02B 6/3897 385/60 |
| 2002/0177160 | A1 | 11/2002 | Padgett et al. | |
| 2005/0104798 | A1 | 5/2005 | Nolan et al. | |
| 2005/0146407 | A1 | 7/2005 | Watanabe et al. | |
| 2006/0051999 | A1 | 3/2006 | Allemann et al. | |
| 2007/0259568 | A1 * | 11/2007 | Mackillop | H01R 13/6463 439/638 |
| 2008/0311779 | A1 * | 12/2008 | Brassell | H01R 13/5202 439/345 |
| 2009/0070997 | A1 | 3/2009 | Yavari et al. | |
| 2009/0156037 | A1 * | 6/2009 | Zayas | H01R 13/6275 439/232 |
| 2010/0144183 | A1 | 6/2010 | Nania et al. | |
| 2011/0151714 | A1 * | 6/2011 | Flaherty | H01R 13/6277 439/578 |
| 2012/0149230 | A1 * | 6/2012 | Dove | H01R 13/22 439/345 |
| 2013/0122735 | A1 | 5/2013 | Pfeiffer | |
| 2013/0149031 | A1 | 6/2013 | Changsrivong et al. | |
| 2014/0342593 | A1 * | 11/2014 | Murphy | H01R 13/567 439/359 |

FOREIGN PATENT DOCUMENTS

| | | | |
|---|---|---|---|
| AU | 719719 | B2 | 5/2000 |
| AU | 2002362011 | A1 | 6/2003 |
| CA | 1315857 | C | 4/1993 |
| CA | 2209507 | A1 | 1/1998 |
| CN | 1645686 | A | 7/2005 |
| CN | 100456570 | C | 1/2009 |
| DE | 1872755 | U | 5/1963 |
| DE | 4014497 | C1 | 3/1991 |
| DE | 19917549 | C1 | 11/2000 |
| DE | 10121675 | A1 | 11/2001 |
| DE | 69716176 | T2 | 8/2003 |
| DE | 102004028060 | A1 | 1/2006 |
| DE | 60209554 | T2 | 2/2007 |
| DE | 102005060657 | A1 | 6/2007 |
| DE | 60224537 | T2 | 1/2009 |
| DE | 10121675 | B4 | 12/2013 |
| EP | 334609 | B1 | 5/1994 |
| EP | 818854 | B1 | 10/2002 |
| EP | 1151500 | B1 | 12/2003 |
| EP | 1050931 | A1 | 7/2004 |
| EP | 1050931 | B1 | 7/2004 |
| EP | 1450449 | A1 | 8/2004 |
| EP | 1557913 | A1 | 7/2005 |
| EP | 1603200 | A1 | 12/2005 |
| EP | 1468192 | B1 | 3/2006 |
| EP | 1405376 | B1 | 1/2008 |
| EP | 2246940 | A1 | 11/2010 |
| EP | 2253977 | A3 | 7/2011 |
| EP | 2362492 | A1 | 8/2011 |
| EP | 2253977 | B1 | 5/2012 |
| EP | 1747042 | B1 | 5/2013 |
| EP | 2602493 | A1 | 6/2013 |
| ES | 2184962 | T3 | 4/2003 |
| FR | 1323550 | A | 4/1963 |
| GB | 997445 | A | 7/1965 |
| GB | 2253528 | A | 9/1992 |
| GB | 2315167 | A | 1/1998 |
| GB | 2326538 | A | 12/1998 |
| GB | 2373380 | A | 9/2002 |
| GB | 2373380 | B | 11/2004 |
| GB | 2435746 | A | 9/2007 |
| GB | 2435746 | B | 9/2008 |
| GB | 2477987 | A | 8/2011 |
| GB | 2477987 | B | 1/2014 |
| JP | 2005510669 | A | 4/2005 |
| JP | 2007532255 | A | 11/2007 |
| KR | 2005076803 | A | 7/2005 |
| TW | 200525838 | A | 12/1993 |
| WO | 9852172 | A2 | 11/1998 |
| WO | 9852172 | A3 | 5/1999 |
| WO | 0045469 | A1 | 8/2000 |
| WO | 0117068 | A1 | 3/2001 |
| WO | 03003521 | A2 | 1/2003 |
| WO | 03003521 | A3 | 1/2003 |
| WO | 03046392 | A3 | 8/2004 |
| WO | 2004102748 | A1 | 11/2004 |
| WO | 2005101078 | A1 | 10/2005 |
| WO | 2005105207 | A2 | 11/2005 |
| WO | 2007071479 | A1 | 6/2007 |
| WO | 2007127514 | A2 | 11/2007 |
| WO | 2008144270 | A1 | 11/2008 |
| WO | 2010046242 | A2 | 4/2010 |
| WO | 2011031673 | A2 | 3/2011 |
| WO | 2011031673 | A3 | 5/2011 |
| WO | 2012049169 | A1 | 4/2012 |

* cited by examiner

ELECTRICAL CONNECTOR

CROSS-REFERENCE TO RELATED APPLICATIONS

This application claims priority under 35 U.S.C. §119(a) to GB1409239.9, which is entitled "Electrical Connector" and was filed May 23, 2014 in UK Intellectual Property Office. The entirety of the aforementioned application is incorporated by reference herein.

TECHNICAL FIELD

This invention relates to an electrical connector for terminating an electrical cable, such as a shielded cable. In particular, the invention relates to a so-called locking "breakaway" connector, which can be firmly engaged with a mating connector and locked into position to prevent accidental disengagement but can be quickly and easily disengaged when required.

BACKGROUND

U.S. Pat. No. 2,761,111 discloses a known breakaway electrical connector for terminating an electrical cable. The electrical connector is arranged to be mechanically engagable with a mating electrical connector to provide an electrically conductive path from the electrical cable to the mating connector. The connectors can be firmly engaged but quickly and easily disengaged when required.

The mating electrical connector described in the US patent is a female connector having a receptacle within which is formed an annular groove. An endless coil spring is retained within the annular groove and partially protrudes therefrom. A plurality of elongate contacts is also arranged within the receptacle and maintained in a parallel longitudinal configuration by a dielectric spacing element.

The cable-terminating connector described in the US patent is a male connector in the form of a plug. A rearward end of the plug is provided with an opening for routing the cable away from the connector in a longitudinal direction. A forward end portion of the plug is provided with an annular groove which is shaped and dimensioned to receive the protruding part of the endless coil spring when the plug and the receptacle of the mating connector are engaged. A plurality of elongate sprung contacts is also arranged within the plug and maintained in a parallel longitudinal configuration by a dielectric spacing element.

The forward tip of the plug is tapered to exert a cam action, whereby an inward thrust of the plug into the receptacle of the mating connector will expand the coil spring to enable the spring to snap into the annular groove formed in the plug, and thus maintain the engagement of the connectors. In this way the sprung contacts of the plug may be held in firm pressure engagement with the fixed contacts of the receptacle to provide the electrically conductive path. The connectors are disengaged by exerting a longitudinal or transverse force on the plug or the cable to thereby expand the coil spring to enable the spring to snap out of the annular groove formed in the plug.

A problem associated with the known breakaway connector arrangement disclosed in U.S. Pat. No. 2,761,111 is that tension on the electrical cable can lead to accidental disengagement of the connectors. Furthermore, tension applied on the cable for deliberately disengaging the connectors may cause excessive stress on the connections and lead to damage.

GB 2 477 987 discloses an angled electrical connector for terminating an electrical cable and for engaging with a mating electrical connector. The angled connector comprises a body having an engagement portion including a sleeve which extends in a longitudinal first direction for engaging with the mating electrical connector, the body further having an opening for routing conductors of the cable away from the connector. At least one resilient member is arranged on the sleeve of the engagement portion, the resilient member being capable of deforming in a transverse direction perpendicular to the first direction and providing a reaction force for maintaining the engagement of the connector with the mating connector.

The opening of the body for routing the conductors of the cable away from the connector is arranged to route the cable in a second direction substantially perpendicular to the first direction. The resilient member comprises a coil spring extending about the sleeve of the engagement portion, the coils of the coil spring having a canted arrangement.

In this design, tension on the cable is less likely to lead to accidental disengagement with a mating electrical connector. In particular, the tension on the cable is in a direction which is substantially perpendicular to the direction of a force required for disengaging the connectors. Furthermore, when the mating connector is mounted in a panel, the connectors may be conveniently disengaged by inserting a user's hand between the panel and the cable to pivoting the cable away from the panel.

Such 'breakaway' connectors have a further advantage in that the pushing on and pulling off of the connector provides a significant tactile feedback to the operator that the connector has made a good contact, even when the operator is operating in poor environmental conditions which require protective clothing. For example in cold and freezing conditions thick gloves are needed to be worn which would dull the tactile experience. However such breakaway connectors as shown in U.S. Pat. No. 2,761,111 and GB 2477987 generally have a problem in that a sufficient applied force or force applied in a specific direction, such as an accidental collision, may disengage the cable and connector.

In this context, there is a need for a design which maintains the advantages of breakaway connectors but that accidental disengagement is prevented not only by a pivoting action.

BRIEF SUMMARY

According to the invention, there are provided connectors as defined in the claims.

In one aspect, the invention provides an electrical connector for terminating an electrical cable and for engaging with a mating electrical connector, the connector comprising: a body having an engagement portion including a sleeve which extends in a longitudinal first direction for engaging with the mating electrical connector, the sleeve further comprising at least one keyway configured to receive a keyed mating connector at a keyway opening; an inwardly at least one resilient member arranged on the sleeve of the engagement portion, the resilient member being capable of deforming in a transverse direction perpendicular to the first direction and providing a reaction force for maintaining the engagement of the connector with the mating connector; and a collar configured to be rotatable about at least the sleeve, wherein the collar comprises a radially inwardly protruding pin which extends into the sleeve and can be moved between two positions, one of the two positions being within the keyway between the key of the mating connector and the keyway opening such that the pin prevents axial disengagement of the connector.

This design makes use of a sleeve having a keyway and inwardly protruding pin, so that the accidental release of the mating electrical connector is avoided by moving the pin into a position being within the keyway between the key of the mating connector and the keyway opening.

The other of the two positions may be within the keyway shielded by the sleeve such that the pin is unable to engage with the key of the mating connector.

Thus this design permits embodiments where the mating connector is releasably coupled by moving the pin into the other of the two positions such that the pin is shielded by the sleeve and not engaging with the key of the mating connector.

The at least one keyway may comprise a circumferential keyway portion configured to receive the radially protruding pin.

Thus in some embodiments the keyway comprises a portion along which the pin can be rotated.

The at least one keyway may comprise an axial keyway portion extending from the keyway opening to a keyway axial stop.

In some embodiments the axial keyway portion enables the mating connector portion to be inserted into the connector keyway in a simple motion.

The axial keyway portion may be intersected by the circumferential keyway portion between the axial keyway stop and the keyway opening such that the key of the keyed mating connector may be configured to be located at the keyway axial stop when the electrical connector is fully engaged with the mating electrical connector and the pin prevents axial disengagement of the connector by being located on the axial keyway between the key of the keyed mating connector and the keyway opening.

The design is such that the intersection between the circumferential keyway portion and the axial keyway portion intersect permitting the pin to move 'behind' the key from the mating connector to lock the mating connector into place.

The electrical connector may comprise a detent device to mechanically latch the sleeve in at least one of the two positions.

In such embodiments a tactile output may be generated by the detent device to indicate to the user that the mating connector is locked within the connector.

The detent device may comprise at least one axially biased ball bearing located within the collar and configured to engage detents formed in the sleeve at angular positions corresponding to at least one of the two positions.

The electrical connector may further comprise an o-ring located between the collar and sleeve and configured to provide rotational resistance.

The o-ring may be further configured to provide an anti-vibration mechanism.

In such embodiments the o-ring by providing rotational resistance to the sleeve prevents an vibrational driven motion of the sleeve and thus an accidental unlocking or locking of the mechanism.

The at least one resilient member may comprise a coil spring extending about the sleeve of the engagement portion.

The coil spring may be arranged in and retained by a groove or channel formed in the sleeve of the engagement portion such that a portion of the coil spring protrudes out of the groove or channel.

The sleeve may comprise a cylindrical inner portion at a base of the sleeve and a tapered portion, such that the opening of the sleeve is larger than the base.

The sleeve may comprise a second cylindrical inner portion at the opening of the sleeve.

The electrical connector may comprise a set of projecting connection pins provided in a base of the sleeve.

An alignment notch may be provided at a location around the outside of the sleeve.

In such embodiments the design would indicate to the user when the sleeve was in a 'locking' position and when the sleeve was in an 'open' position.

The collar may comprise a shaped outer surface suitable for engaging a spanner to assist rotation of the collar.

The design can therefore be operated using a tool where the physical conditions prevent the user from being able to rotate the sleeve directly, for example by the user wearing bulky protective equipment.

According to a second aspect there may be provided an electrical connector for receiving a mating electrical connector, comprising: a projecting connection port, having electrical contacts within an end face of the port; and a protecting collar circumferentially around the connection port, with a key feature configured to interact with a keyway on the mating electrical connector, wherein the mating electrical connector comprises a radially inwardly protruding pin which when rotated to a position prevents axial disengagement of the electrical connector by locking the key feature within the keyway.

The connection port may comprise a second cylindrical outer portion at the base of the port.

The electrical contacts may comprise recesses in the end face.

The electrical contacts may comprise pads flush with the end face.

A connector arrangement, may comprise: a first electrical connector as described herein; and a second electrical connector as described herein for mating with the first electrical connector.

BRIEF DESCRIPTION OF THE DRAWINGS

An exemplary embodiment of the invention will now be described in detail with reference to the accompanying drawings, which are incorporated herein by reference, in which.

DETAILED DESCRIPTION

The invention provides a locking electrical connector for terminating an electrical cable and for engaging with a mating electrical connector.

The invention provides various modifications to the applicant's previous design of GB 2 477 987 to make the design suitable for locking. The particular problem of connections is that movement in use, and the likelihood of knocking the connection against other objects, means that accidental disconnection is more likely than in static situations.

The design of GB 2 477 987 will first be described, using FIGS. 1 to 4 from GB 2 477 987. Further details can be found in GB 2 477 987.

Figure 1A:
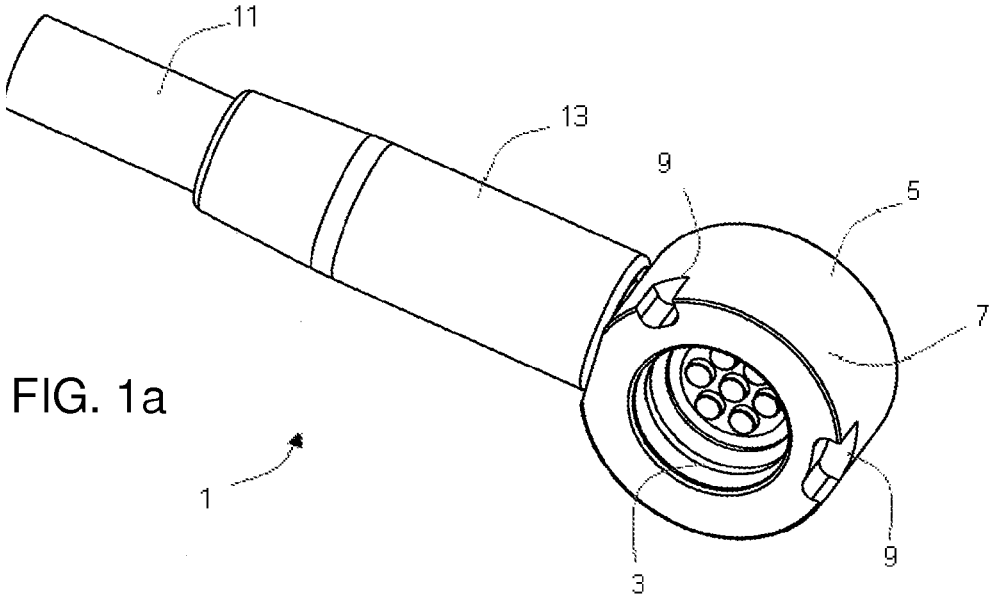
FIG. 1*a* is a perspective view of a known angled electrical connector according to the invention.

FIG. 1*a* shows the underside of the known angled electrical connector 1. The angled connector 1 is a female connector having a receptacle 3 for receiving a male connector (not shown in FIG. 1*a*). A plurality of elongate electrical contacts is arranged within the receptacle 3.

The angled connector 1 comprises a metallic outer body 5 and has an engagement portion including a circular sleeve 7 for engaging the male connector. The sleeve 7 has a generally cylindrical outer shape and extends (axially) in a longitudinal first direction. An outer surface of the sleeve 7 is provided with notches 9 which align with corresponding features of the male connector to ensure correct circumferential alignment when the connectors are brought into engagement. An inner surface of the sleeve 7 has a circular cross section and is provided with engagement means for mechanically coupling the connectors, as will be described in more detail herein below.

The connector body 5 also has a collar portion 13 extending in a second direction which is perpendicular to the first direction. The collar portion defines an elongate opening for routing the inner conductors of a terminated cable 11 away from the connector 1.

Figure 1B:
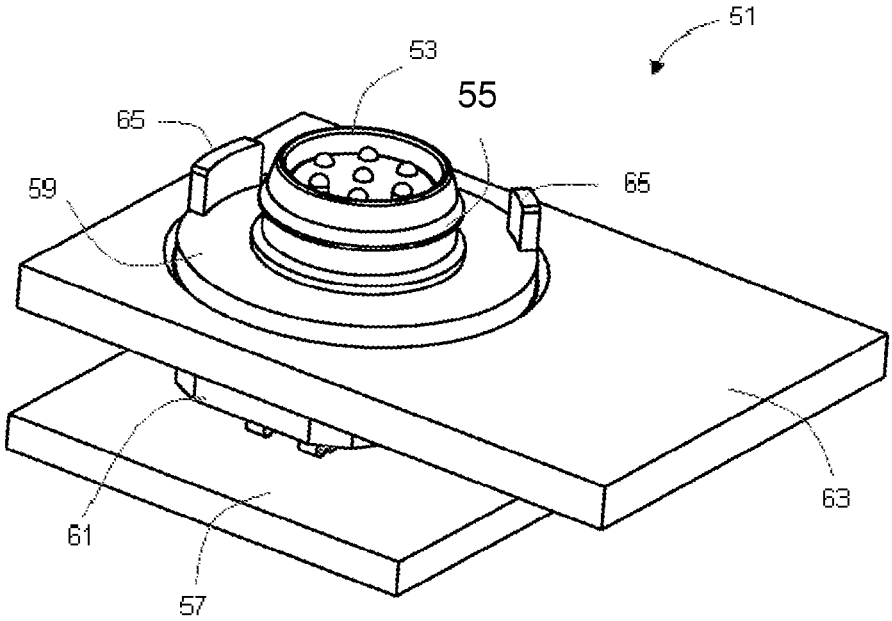
FIG. 1*b* is a perspective view of a known electrical connector for mating with the angled connector shown in FIG. 1.

FIG. 1*b* shows an electrical connector 51 intended for mating with the angled connector 1 shown in FIG. 1*a*. The mating connector 51 is a male connector comprising an outer body 53 formed, for example, of nickel-plated stainless steel. The body 53 of the mating connector 51 has an engagement portion including a longitudinally-extending sleeve 55 for engaging the angled connector 1. A plurality of elongate electrical contacts is arranged within the sleeve 55 for connection to the tracks of a printed circuit board 57. An outer surface of the sleeve 55 is provided with engagement means for mechanically coupling the connectors 1, 51.

The mating connector body 55 also has an annular mounting flange 59, a threaded section (not shown in FIG. 1*b*) adjacent to the mounting flange 59, and a lock nut 61 for mounting the connector 51 to an equipment panel 63. The mounting flange 59 is provided with longitudinally-extending posts 65 which align with the notches 9 formed in the angled connector 1 to ensure correct circumferential alignment when the connectors 1, 51 are brought into engagement.

Figure 2:
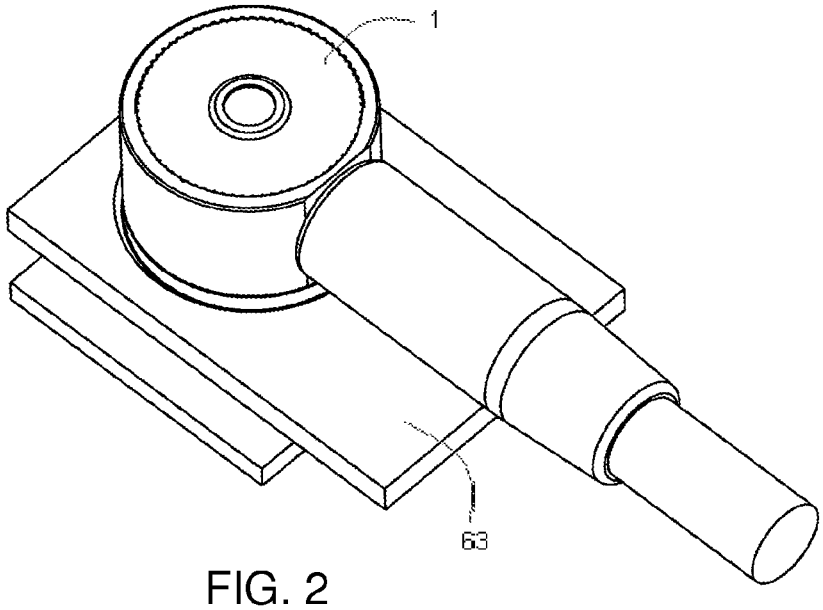
FIG. 2 is a perspective view of the connectors shown in FIGS. 1*a* and 1*b* in the mated configuration.

FIG. 2 is a perspective view of the connectors 1, 51 shown in FIGS. 1*a* and 1*b* in the mated configuration. As will be seen, in the mated configuration, the angled connector 1 entirely covers the portion of the mating connector 51 which is exposed above the equipment panel 63 in which it is mounted.

Figure 3:
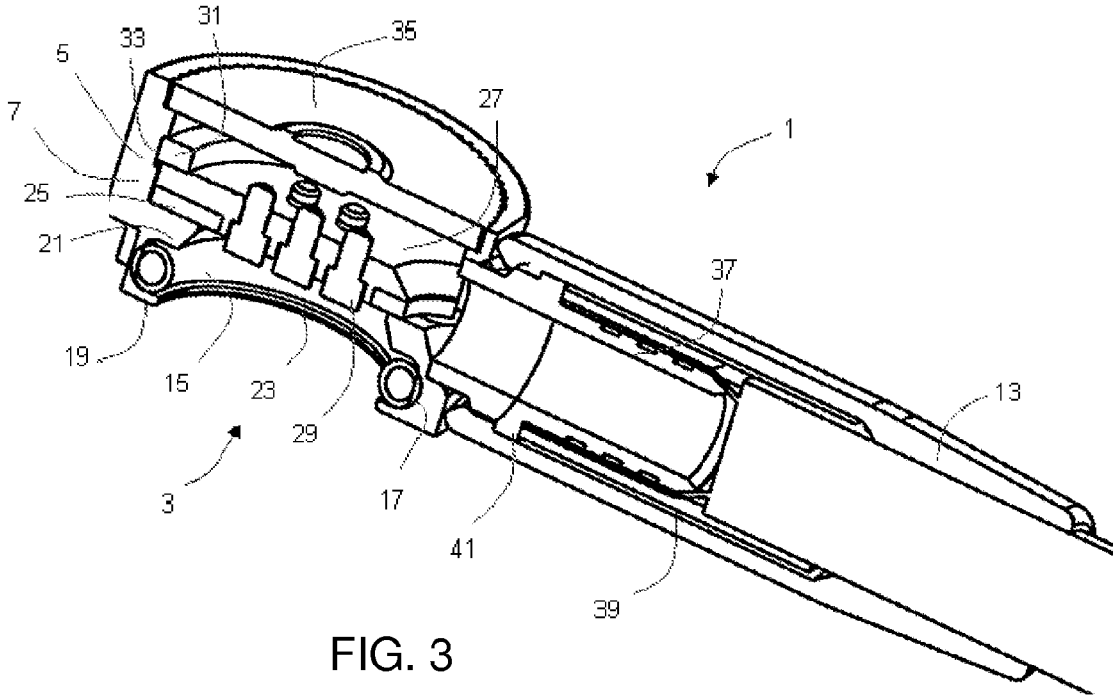
FIG. 3 is a cut-away perspective view showing the connector of FIG. 1*a* in more detail.

FIG. 3 shows the angled connector 1 shown in FIG. 1*a* in greater detail. The Figure shows the connector body 5 and the protective rubber boot 13 described above, together with other features of the connector 1. Thus, the connector 1 further comprises a resilient member in the form of an endless coil spring 15. The coil spring 15 is arranged in and retained by an annular groove 17 formed in the inner surface of the sleeve 7 of the outer body 5. A portion of each coil of the coil spring 15 protrudes from the annular groove, as illustrated. The coil spring 15 has a canted arrangement whereby the coils of the spring are canted with respect to a centerline of the coil spring 15. Thus, entire coils of the coil spring 15 each define an acute angle with a respective plane normal to the centreline of the spring 15. A radial cross section of the canted coil spring 15 has an elliptical shape. The protruding portion of the spring 15 is displaceable in a radially outward direction, thereby compressing the spring and causing increased canting, in response to which a reaction force acts in a radially inward direction.

The groove 17 in which the canted coil spring 15 is arranged is defined by a pair of spaced apart first and second flanges 19, 21 which extend inwardly from the sleeve 7. The first flange 19 is arranged at a forward end of the sleeve 7 and has a distal end which defines an annular abutment surface 23. The abutment surface 23 is parallel to the longitudinal (first) direction and is intended for abutting a corresponding surface of the mating connector 51 for preventing transverse displacement of the connectors 1, 51 with respect to each other when they are in the fully engaged configuration.

The second flange 21 has a distal end which defines a frustro-conical surface. The frustro-conical surface is intended for longitudinally and transversely locating the connector 1 with respect to the mating connector 51 as the connectors 1, 51 are brought into engagement.

The connector 1 further comprises an electrical contact assembly which is housed within the sleeve 7 of the connector body 5, behind the second flange 21. The electrical contact assembly comprises an annular seal 25, a dielectric spacing element 27 provided with a plurality of through holes extending in the first direction, and a plurality of fixed elongate conductive solder contacts 29 arranged in respective through holes of the spacing element 27 for providing electrical connections. The annular seal 25 of the contact assembly is maintained in pressure contact with the second flange 21 by a resilient retaining ring 31 which is received in a second groove 33 formed in the inner surface of the sleeve 7 and bears against the spacing element 27.

A rearward end of the sleeve 7 is provided with a disc-shaped shielding cap 35 which covers the electrical contact assembly and is attached to the body 5 after the inner conductors of the terminated cable have been soldered to the solder contacts 29. A space between the electrical connection assembly and the shielding cap 35 may be potted with a sealant material for additional protection against ingress of moisture and other contaminants.

The collar portion 37 of the connector body 5 is clearly visible in FIG. 3. As described above the collar portion 37 provides an elongate opening extending in the second direction for routing the inner conductors of the cable. An outer surface of the collar portion 37 defines a crimp barrel for receiving the outer conductor, or braid, of the cable and over which a ferrule 39 is crimped in a conventional manner which will be well understood by the skilled person. The collar portion 37 is provided with the protective boot 13, as illustrated in the Figure, which is maintained in position by engagement with a circumferential flange 41 formed on the outer surface of the collar portion 27.

Figure 4:
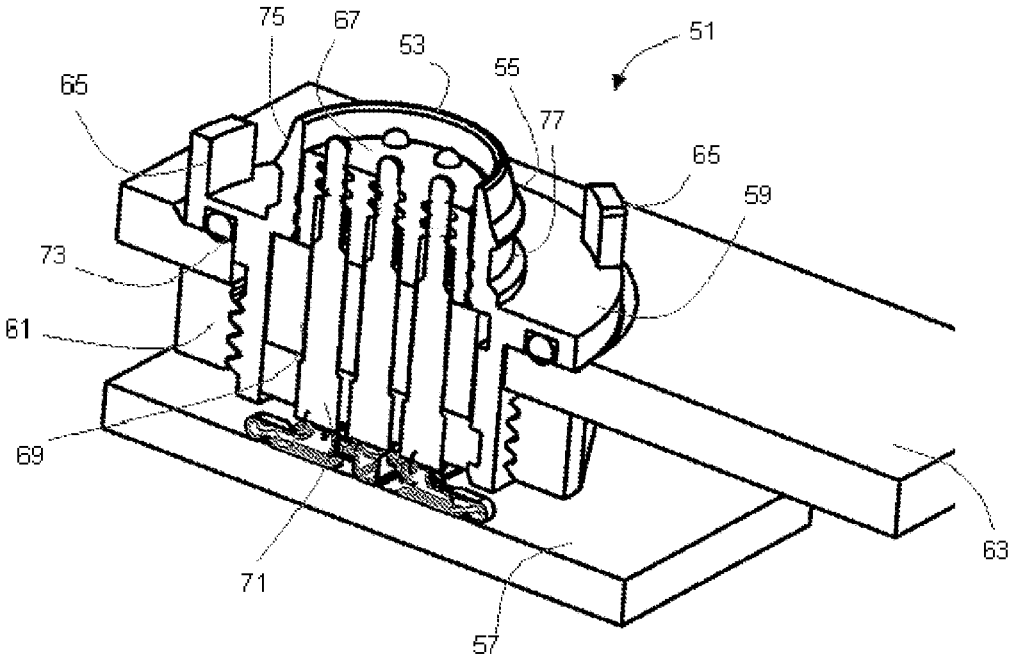
FIG. 4 is a cut-away perspective view showing the connector of FIG. 1*b* in more detail.

FIG. 4 shows the mating connector 51 shown in FIG. 1*b* in greater detail. The Figure shows the connector body 53 and lock nut 61 described above, together with other features of the connector 51. Thus, the connector further comprises an electrical contact assembly which is housed within the sleeve 55 of the connector body 53. The electrical contact assembly comprises a resilient seal 67, a dielectric spacing element 69 provided with a plurality of through holes, and a plurality of elongate conductive solder contacts 71 arranged in respective through holes of the spacing element 69 for providing electrical connections. The solder contacts 71 may, for example, be soldered directly to the conductive tracks of a printed circuit board 57, as illustrated. The solder contacts 71 are so-called pogo contacts in that they are provided as two parts which can be pressed together against the action of a compression coil spring (not shown) arranged inside the contacts 71. The use of such sprung contacts ensures a firm pressure engagement between the contacts 29, 71 of the two connectors 1, 51 when the connectors 1, 51 are in the mated configuration.

The mounting flange 59 of the mating connector 51 is provided with a groove in its surface which faces the mounting panel 63. A resilient sealing member, such as a rubber "O" ring is received in the groove for preventing ingress of moisture and other contaminants between the connector 51 and the panel 63.

An outer surface of the sleeve 55 of the connector body 53 is profiled to define a cam surface for bearing against the canted coil spring 15 of the angled connector 1 when the connectors 1, 51 are brought into engagement with each other. In particular, a forward end of the outer surface of the sleeve 55 is provided with a substantially frustro-conical (tapered) surface 75 having a diameter which gradually increases away from a leading edge of the sleeve 55. The frustro-conical surface 75 leads into a circumferential groove 77 which is arranged for receiving the canted coil spring 15 when the connectors 1, 51 are in the mated configuration. The frustro-conical surface 75 serves two purposes: firstly, it progressively bears against and displaces the canted coil spring 15 when the connectors 1, 51 are brought into engagement, as mentioned above, so that the coil spring 15 is able to compress and then snap into the groove 77. Secondly, it may cooperate with the corresponding frustro-conical surface of the angled connector 1 to longitudinally and transversely locate the connectors 1, 51 with respect to each other as they are brought into engagement.

A portion of the outer surface of the sleeve 55 of the connector body 53 adjacent to the mounting flange 59 is provided with an annular abutment surface 79. The abutment surface 79 is parallel to the connector axis and is intended for abutting the corresponding surface of the angled connector 1 for preventing transverse displacement of the connectors 1, 51 with respect to each other when they are in the fully engaged configuration.

The disclosure as provided herein provides various design changes to make the connector more suitable in situations where accidental disconnection is a hazard. In other words in environment where there is significant numbers of connections and disconnections occurring, for example where the "equipment panel" 63 such as shown in FIG. 1*b* is a surface on which many connectors are required. The connection mechanism remains the same or similar with the same use of a circumferential spring which is a snap fit into a channel.

The modifications comprise:

a rotatable collar comprising a inwardly directed pin which is configured in one position to project through a keyway in the connector body and to lock a mating key of the mating connector within the keyway;

the keyway designed such that the pin on the collar in an further or unlocked position is hidden or shielded and does not interfere with the insertion of the mating connector;

the connector body comprising a detent configured to receive a spring loaded ball bearing to provide feedback as when the rotatable collar is located in a locked and unlocked position;

the connector body and collar configured with a o-ring between them to provide suitable anti-vibration means.

Figure 5:
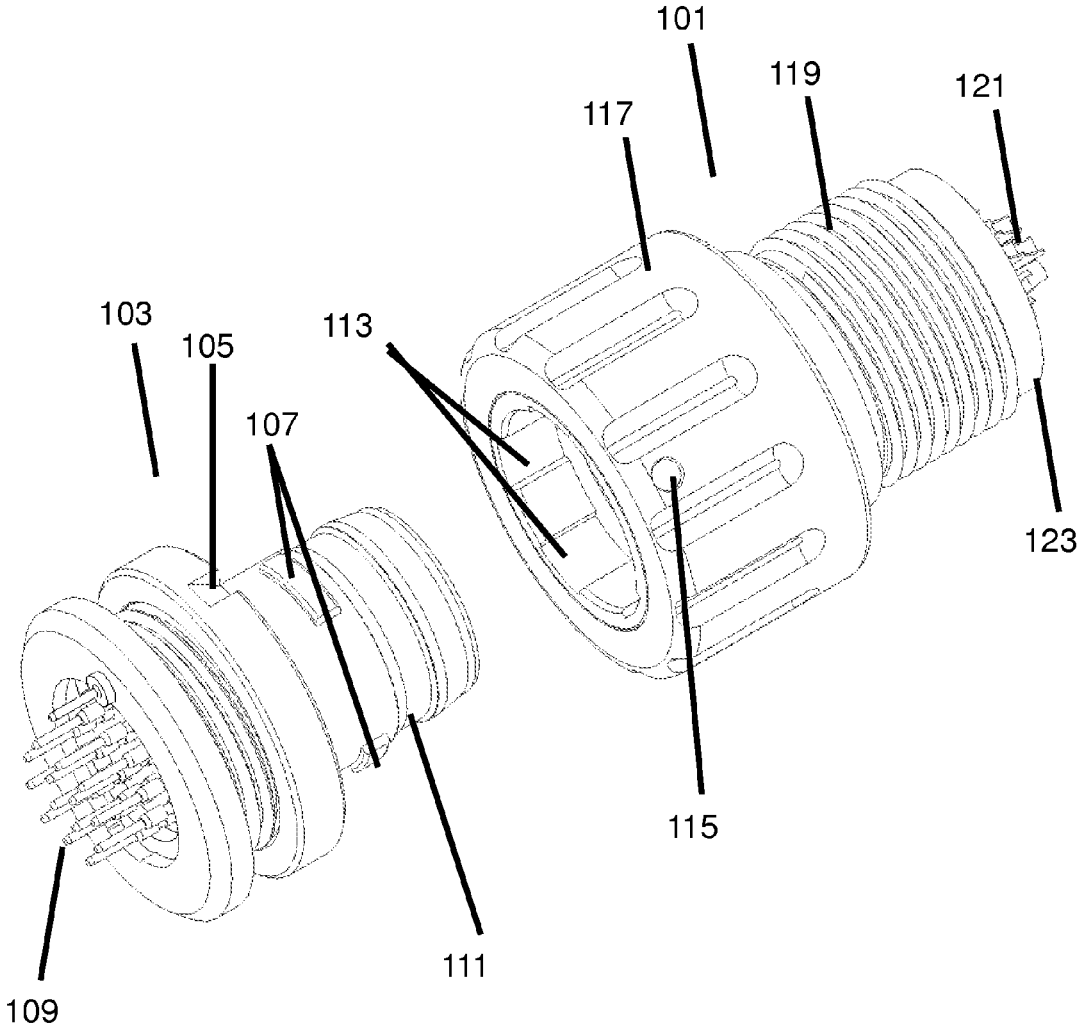
FIG. 5 is a perspective view of a lockable electrical connector and a mating connector before connection according to some embodiments.

FIG. 5 shows a perspective projection of the electrical connector 101 and the mating connector 103 in an uncoupled state, in other words separated from each other. Although in the following examples a connector 101 and mating connector 103 are described it would be understood that the terms can be reversed. For example the mating connector 103 can in some embodiments be referred to as the receptacle part which is mounted on the equipment panel or similar. Thus for example the mating connector 103 can comprise an inner portion comprising the mating connector pin contacts 109 which pass through the cylindrical or tapering body and end in connecting pins or pads suitable for conducting electrical signals to associated pins or pads in the electrical connector 101 and which pass through and exit the electrical connector 101 at the electrical connector pin contacts 121. Furthermore the mating connector 103 can in some embodiments comprise an outer portion, a generally cylindrical outer body part which at least partially surrounds and attaches to the inner portion by a suitable screw thread or other connection means. In some embodiments the inner and outer portions comprise collar portions or faces which grip the 'equipment panel' wall or case wall on which the mating connector 103 or receptacle part is located.

The mating connector 103 and the outer portion can in some embodiments comprise a spanner detent 105 on a jamnut. In some embodiments the mating connector 103 can further comprise an alignment or rotational location feature 105. The alignment feature 105 in some embodiments can be a paint band, dot or similar on the top of the master key and is configured to indicate an approximate position of at least one of the mating connection key elements 107 such that when the mating connector 103 is affixed, for example to an equipment panel, the orientation of the connector is indicated to the user.

The mating connector 103 furthermore comprises at least one key element 107 located on the outer surface of the mating connector outer portion. In the example shown in FIG. 5 the mating connector outer portion is shown with two of four key elements 107 which are configured to slot into an associated keyway 113 within the connector inner surface. Furthermore in the example shown in FIG. 5 shows that the four keyways, and therefore the four key elements, are approximately regularly distributed about the circumference that the number and distribution can be any number and distribution. Furthermore, although the key elements 107 are shown as being portions of a circumferential ridge, in other words the key elements being located about the same circumferential ring, it would be understood that the key elements 107 can in some embodiments be located at different locations axially along the mating connector body.

The mating connector 103 body and particularly an outer surface of the mating connector body furthermore comprises at least one circumferential groove 111 for bearing against the canted coil spring within the connector 101. In other words the connector body may be profiled to define a cam surface for bearing against the canted coil spring of the connector 101 when the connectors 101, 103 are brought into engagement with each other. In some embodiments, a forward end of the outer surface of the mating connector 103 body can be provided with a substantially frustro-conical (tapered) surface having a diameter which gradually increases away from a leading edge of the body. The frustro-conical surface leads into a circumferential groove 111 which is arranged for receiving the canted coil spring when the connectors 101, 103 are in the mated configuration. The frustro-conical surface serves two purposes: firstly, it progressively bears against and displaces the canted coil spring when the connectors 101, 103 are brought into engagement, as mentioned above, so that the coil spring is able to compress and then snap into the groove 111. Secondly, it may cooperate with the corresponding frustro-conical surface of the mating connector 103 to longitudinally and transversely locate the connectors 101, 103 with respect to each other as they are brought into engagement.

In the embodiments shown herein the mating connector 103 body is arranged such that the circumferential groove 111 is located nearer towards the end for receiving the connector 101 than the at least one key element 107, however in some embodiments the mating connector 103 body and the at least one key element 107 can be designed such that the at least one key element 107 is located nearer towards the end for receiving the connector 101 than the circumferential groove 111.

The connector 101 furthermore is shown in FIG. 5 comprising a body 123 (or body portion). The connector 101 further comprises a resilient member in the form of an endless coil spring. The coil spring is arranged in and retained by an annular groove formed in the inner surface of the body 123.

The connector 101 further comprises an electrical contact assembly 121 which is housed within the body 123 of the connector 101, and in some embodiments behind the second flange. The electrical contact assembly 121 can in some embodiments comprise an annular seal, a dielectric spacing element provided with a plurality of through holes extending in the first direction, and a plurality of fixed elongate conductive solder contacts arranged in respective through holes of the spacing element for providing electrical connections. The annular seal of the contact assembly can in some embodiments be maintained in pressure contact with the second flange by a resilient retaining ring which is received in a second groove formed in the inner surface of the body and bears against the spacing element.

The connector body 123 in some embodiments comprises a sleeve portion configured to provide an elongate opening extending in the axial direction for routing the inner conductors of the cable. An outer surface of the sleeve portion defines a screw fitting 119 suitable for receiving a cable boot or shielded screw cable connector. However it would be understood that the connector body 123 (or sleeve) can in some embodiments comprise any other suitable fitting for example a crimp fitting over which a ferrule can be crimped in a conventional manner.

The connector body 123 further comprises on the inner surface at least one keyway configured to receive a key from the mating connector. As is shown in FIG. 5 the inner surface comprises four keyways which extend axially into the connector body 123.

The connector 101 further comprises a collar 117 configured to be rotatable about the connector body 123 (and sleeve portion). The collar 117 is shown herein as a cylindrical form over the connector body 123 and configured such that the opening or end of the connector body 123 and the opening or end of the collar 117 both with respect to the mating connector 103 are flush or aligned such that when the end face or surface of the connector 101 is flat.

The collar 117 in some embodiments comprises an outer surface with a pattern, moulding or machining to assist the rotation of the collar 117 relative to the body 123. For example in FIG. 5 the collar 117 outer surface has axial grooves to help gripping of the outer surface by fingers. However it would be understood that in some embodiments any suitable outer surface structure or surface can be implemented. For example in some embodiments the outer surface of the collar 117 is a shape (for example a hexagonal shape) configured to receive a suitable tool (such as a spanner with a suitable open end for receiving faces from the hexagonal shape) for providing a mechanical advantage in rotating the collar 117.

The collar 117 in some embodiments comprises a radially inwardly protruding pin 115 which extends into the body of the connector (and in some embodiments therefore into the sleeve) and can be moved between two positions by the rotation of the collar 117. In some embodiments the radially inwardly protruding pin 115 is visible on the surface of the collar 117, however in some embodiments the inwardly protruding pin 115 is not visible on the surface of the collar 117. In some embodiments the collar 117 has a marking or visible indicator which can be located directly over the pin 115, but in some embodiments the marking can be a visible marking to provide an indicator to the user of a position of the collar in general and therefore not indicating the location of the pin 115. The pin 115 in some embodiments such as shown in FIG. 5, is a round pin, however any suitable shape of pin can be employed.

The pin 115 in some embodiments radially protrudes inwardly and passes through a slot within the connector body 123 (and sleeve portion). The collar 117 is configured to rotate such that the pin 115 can be rotated into a position (which in some embodiments is one of two end rotational positions) which is within one of the at least one keyway 113 such that when the connectors 101, 103 are engaged the pin 115 is located between the key 107 of the mating connector 103 and the keyway opening such that the pin 115 prevents an axial disengagement of the connector. The collar 117 furthermore is configured to rotate such that the pin 115 can be rotated into a second position (which in some embodiments is the other of two end rotational positions) which is within one of the at least one keyway 113 such that when the connectors 101, 103 are engaged the pin 115 is located within the keyway shielded by the body or sleeve such that the pin 115 is unable to engage with the key 107 of the mating connector 103 and as such enables the connectors 101, 103 to be disengaged.

In some embodiments the connector 101 can further comprise an alignment or rotational location feature, which can be a paint line in the base of one of the knurl grooves to indicate an approximate position of at least one keyway 113 to be aligned with the alignment feature of the mating connector 103 when the collar is in an 'unlocked' or open position.

Figure 6:
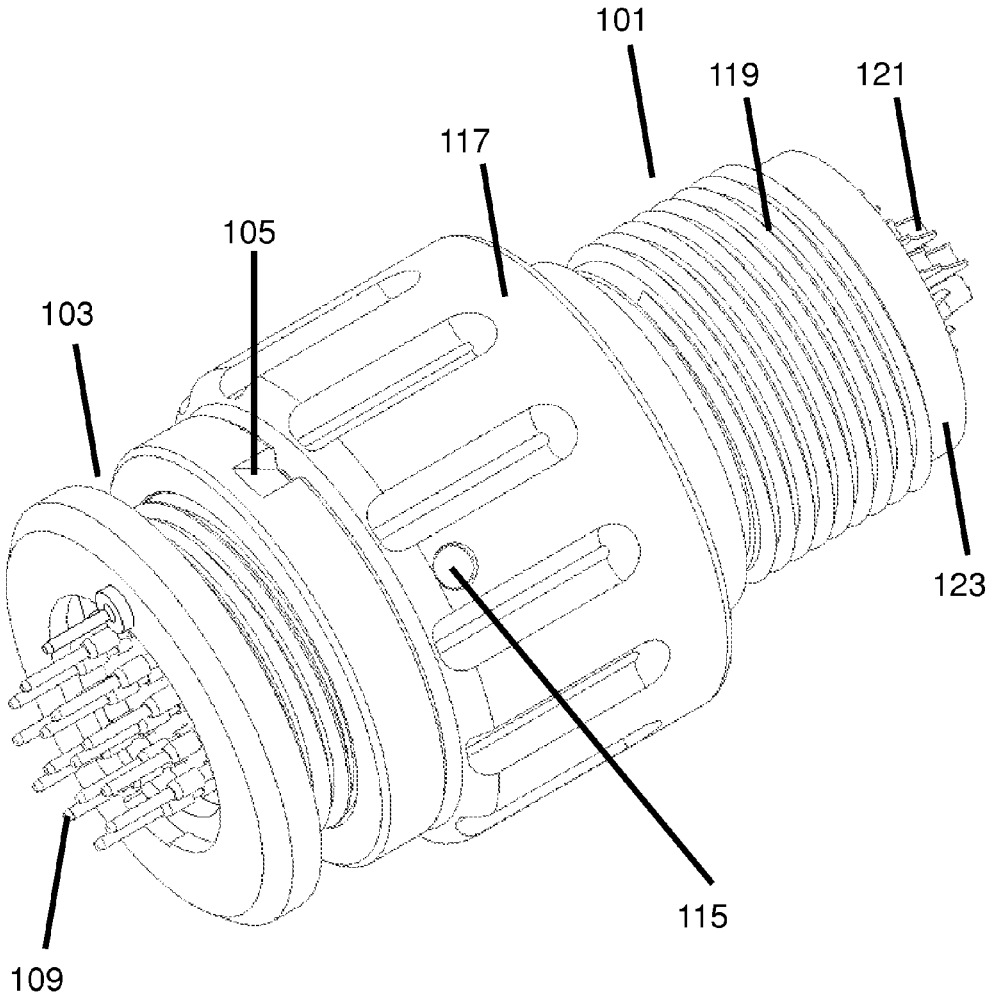
FIG. 6 is a perspective view of a lockable electrical connector and a mating connector after connection where the sleeve and pin is in an 'unlocked' position according to some embodiments.

With respect to FIG. 6 a perspective projection of the electrical connector 101 and the mating connector 103 in a coupled state, in other words engaged with each other is shown. However in the example shown in FIG. 6 the collar 117 and the pin 115 is shown located in the other or second of the two end rotational positions. This can for example be seen in FIG. 6 as the pin 115 is shown (from the viewpoint of the connector) to be anti-clockwise of the alignment feature 105. In this position the pin is shielded within the body or sleeve and thus does not interfere with the coupling or decoupling of the connectors 101, 103 in that the key 107 is free to move axially within the keyway 113.

Figure 7:
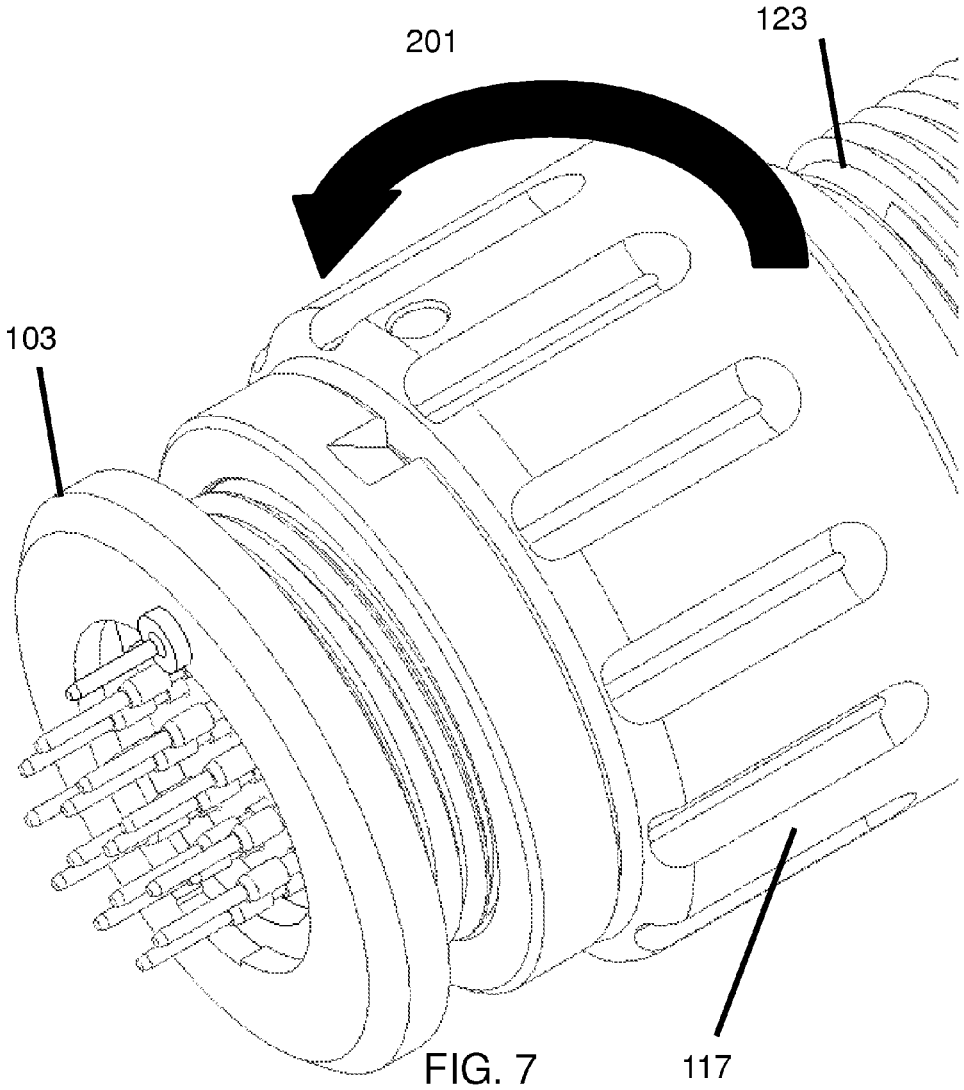
FIG. 7 is a perspective view of a lockable electrical connector and a mating connector after connection where the sleeve and pin is rotated into a 'locked' position according to some embodiments.

With respect to FIG. 7 a perspective projection of the electrical connector 101 and the mating connector 103 in a coupled state, in other words engaged with each other is shown where the collar 117 and the pin 115 is shown having been rotated clockwise (from the viewpoint of the connector 101) and therefore the collar 117 and the pin 115 are located in the first of the two end rotational positions. This can for example be seen in FIG. 7 as the pin 115 is shown (from the viewpoint of the connector) to be clockwise of the alignment feature 105.

Figure 8:
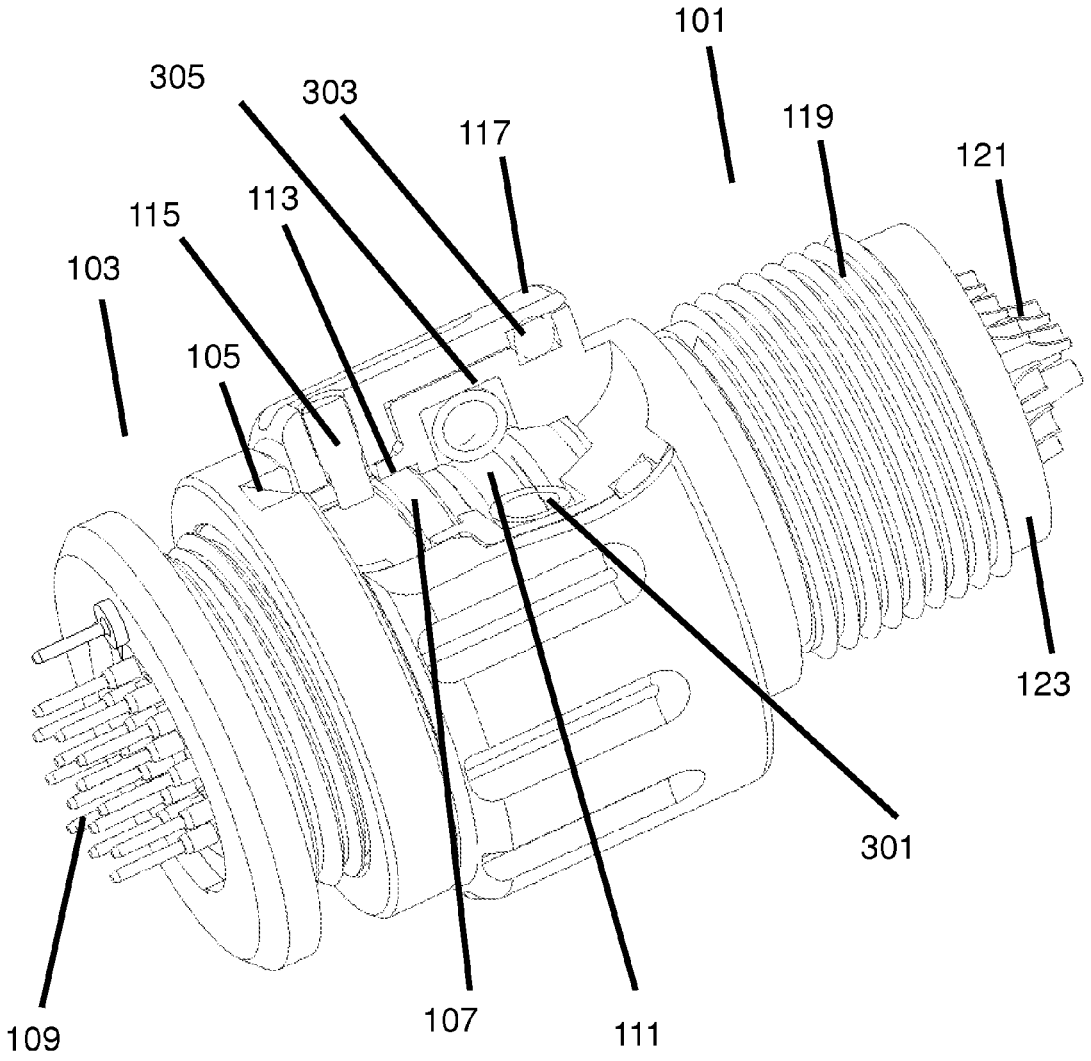
FIG. 8 is a partially cut-away perspective view of a lockable electrical connector and a mating connector after connection where the sleeve and pin is rotated into a 'locked' position according to some embodiments.

With respect to FIG. 8 a cross-sectional perspective projection of the electrical connector 101 and the mating connector 103 in a coupled state, in other words engaged with each other is shown where the collar 117 and the pin 115 is shown having been rotated clockwise (from the viewpoint of the connector 101) and therefore the collar 117 and the pin 115 are located in the first of the two end rotational positions is shown. In this position the pin 115 is located within the body or sleeve between the key 107 of the mating connector 103 and the keyway opening such that the pin 115 prevents an axial disengagement of the connector. FIG. 8 furthermore shows the resilient member in the form of an endless coil spring 301. The coil spring 301 is arranged in and retained by an annular groove 305 formed in the inner surface of the body 123. A portion of each coil of the coil spring 301 protrudes from the annular groove. The coil spring 301 has a canted arrangement whereby the coils of the spring are canted with respect to a centreline of the coil spring 301. Thus, entire coils of the coil spring 301 each define an acute angle with a respective plane normal to the centreline of the spring 301. A radial cross section of the canted coil spring 301 has an elliptical shape. The protruding portion of the spring 301 is displaceable in a radially outward direction, thereby compressing the spring and causing increased canting, in response to which a reaction force acts in a radially inward direction.

The groove in which the canted coil spring 301 is arranged can in some embodiments be defined by a pair of spaced apart first and second flanges which extend inwardly from the body 123. The first flange is arranged at a forward end of the body 123 and has a distal end which defines an annular abutment surface. The abutment surface can in some embodiments be parallel to the longitudinal (first) direction and can be configured to abut a corresponding surface of the mating connector for preventing transverse displacement of the connectors 101, 103 with respect to each other when they are in the fully engaged configuration.

The second flange in some embodiments can be configured with a distal end which defines a frustro-conical surface. The frustro-conical surface can be configured to longitudinally and transversely locate the connector 101 with respect to the mating connector 103 as the connectors 101, 103 are brought into engagement.

Furthermore FIG. 8 shows that in some embodiments an o-ring 303 can be located between the collar 117 and connector body 123. The o-ring 303 can for example be located within a channel created by a circumferential groove in the connector body 123 (or sleeve 119) and the collar 117 and be configured to provide rotational resistance. The o-ring 303 can for example be a rubber or polyurethane ring or any suitable material. Furthermore the o-ring 303 can be further configured to provide an anti-vibration mechanism with respect to the collar 117 and the body 123 rotating under vibration.

In some embodiments the connector slot through which the pin 115 projects is part of a circumferential keyway portion configured to receive the radially protruding pin 115. Furthermore in some embodiments the at least one keyway 113 comprises an axial keyway portion extending from the keyway opening to a keyway axial stop. In such embodiments the axial keyway portion is intersected by the circumferential keyway portion between the axial keyway stop and the keyway opening. Furthermore the keyways portions intersect such that when the connectors 101, 103 are engaged the key of the keyed mating connector is configured to be located at the keyway axial stop position (in other words when the electrical connector is fully engaged with the mating electrical connector) and the pin 115 prevents axial disengagement of the connector 101 from the mating connector 103 by being located on the axial keyway between the key 107 of the mating connector 103 and the keyway opening.

Figure 9A:
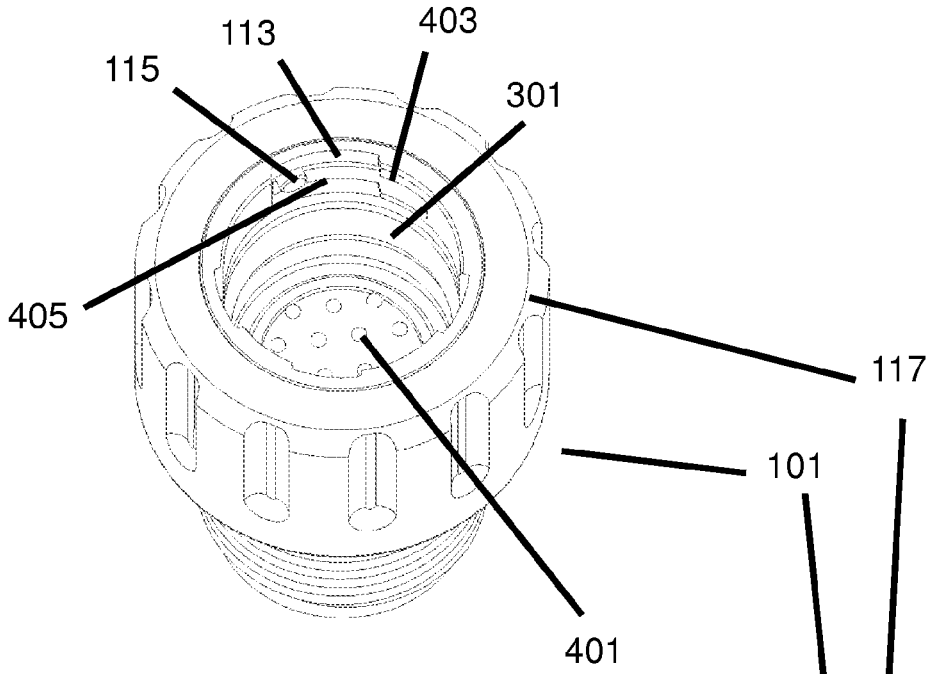
FIG. 9*a* is a further perspective view showing the connector where the sleeve and pin is in a 'locked' position according to some embodiments.
Figure 9B:
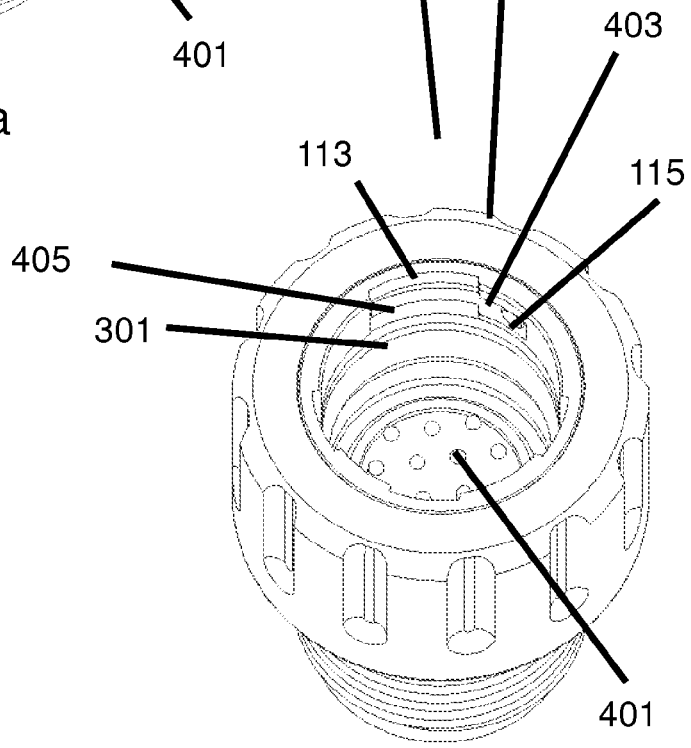
FIG. 9*b* is a further perspective view showing the connector where the sleeve and pin is in an 'unlocked' position according to some embodiments.

With respect to FIGS. 9*a* and 9*b* two end perspective projections of the connector 101 are shown with the collar 117 and the pin 115 in the two end rotational positions respectively. FIG. 9*a* for example shows the connector collar 117 and pin 115 rotated or located at the 'locking' or 'locked' rotational position, wherein the pin 115 is located within the intersecting portion 405 of the circumferential keyway portion and the axial keyway portion 113 and thus the pin projects into the axial keyway between an axial keyway opening and an axial keyway stop. FIG. 9*b* shows the connector collar 117 and pin 115 rotated or located at the 'open' or 'unlocked' rotational position, wherein the pin 115 is located within the shielded portion 403 of the circumferential keyway portion and thus the pin does not project into the axial keyway and furthermore does not interfere with the engagement or disengagement of the connector 101 from the mating connector 103. FIGS. 9*a* and 9*b* furthermore show an example electrical contact assembly contact pad or pin array 401 which when the connectors are engaged provide an electrical connection with associated pins, pads or sockets within the mating connector 103.

Figure 10:
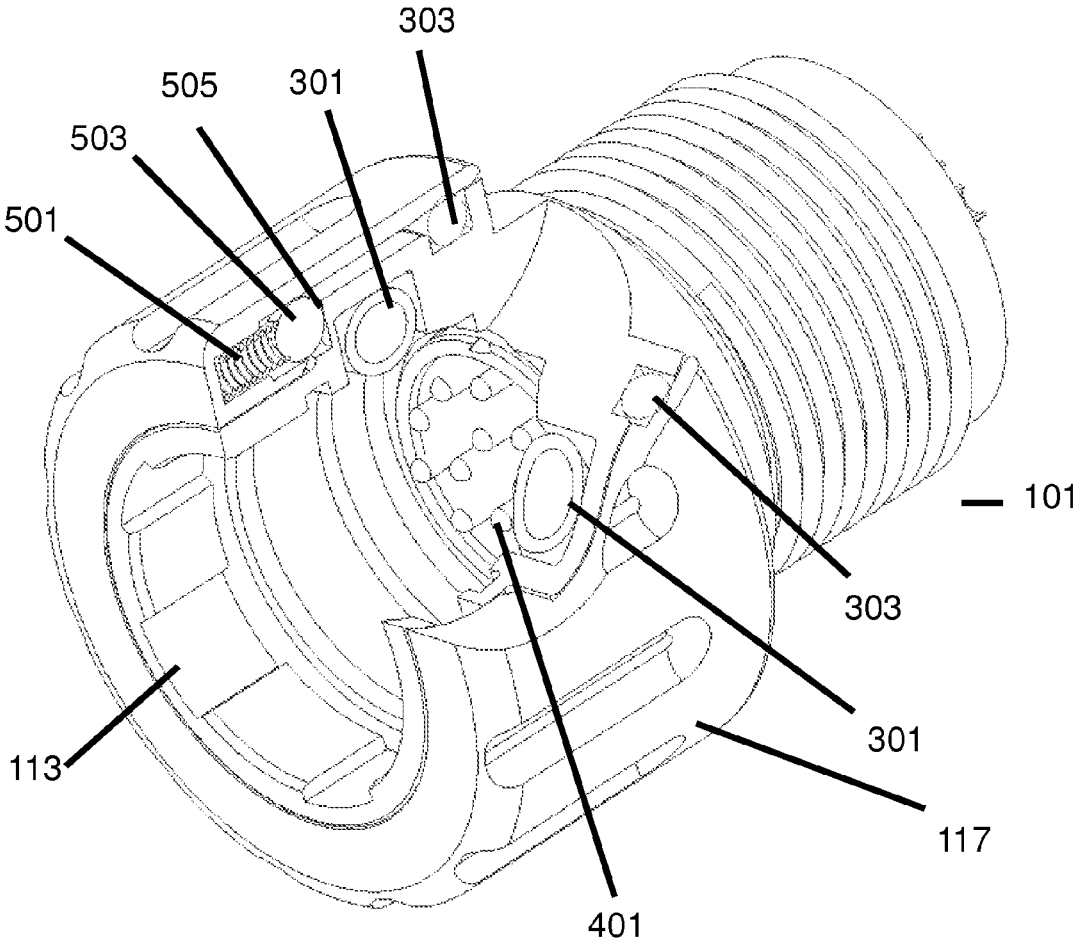
FIG. 10 is a partially cut-away perspective view showing the lockable electrical connector showing the detent and anti-vibration o-ring detail.

With respect to FIG. 10 a cross-sectional perspective projection of the electrical connector 101 is shown. In this view an example detent feature to mechanically latch the collar in at least one of the two end rotational positions is shown. In some embodiments the collar 117 comprises at least one hollow configured to house at least one axially biased ball bearing 503 configured to engage detents 505 formed in the sleeve or body of the connector at angular positions corresponding to at least one of the two positions.

In some embodiments the axial biasing can be produced by a suitable coil spring 501 located within the hollow and between a collar 117 wall (such as the collar end wall) and the ball bearing 503.

Figure 11:
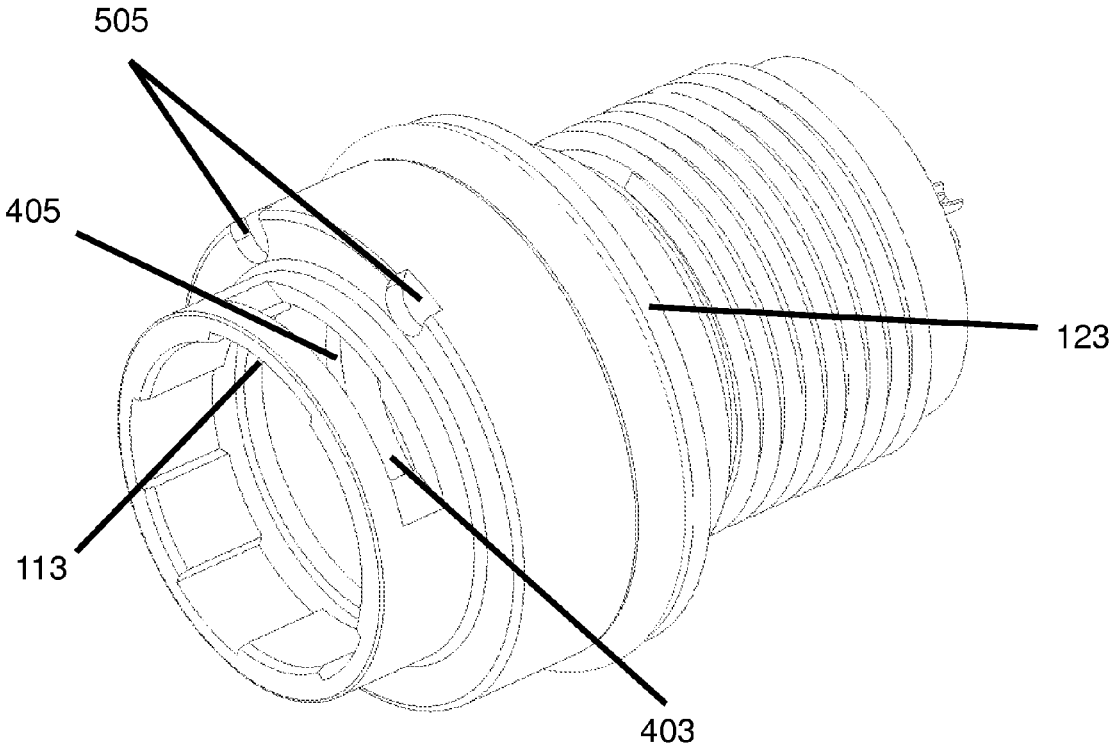
FIG. 11 is a perspective view showing the connector body in more detail.

With respect to FIG. 11 a cross-sectional perspective projection of the electrical connector body or sleeve 123 is shown, in other words the connector 101 without the associated rotatable collar 117. In this example the detents 505 within which the axially biased ball bearing 503 can engage to latch the collar are shown. Furthermore with respect to FIG. 11 is shown the slot through which the pin 115 of the collar can project inwardly and which in some embodiments forms the circumferential keyway along which the pin can travel when the collar and therefore the pin are rotated. Furthermore as shown herein the slot/circumferential keyway comprises an intersecting portion 405 between the circumferential keyway portion and the axial keyway portion 113 through which a inwardly projected pin can be configured to project into the axial keyway 113 between the axial keyway opening and an axial keyway stop, and a shielded portion 403 of the circumferential keyway portion through which the pin does not project into the axial keyway and furthermore does not interfere with the engagement or disengagement of the connector 101 from the mating connector 103.

Although in the FIGS. 5 to 11 a single pin 115 is shown it would be understood that in some embodiments more than one inwardly projecting pin is employed to provide more resistance to any disengagement of the connectors 101, 103. Furthermore in such embodiments the electrical connector body or sleeve 123 comprises more than one slot which form suitable circumferential keyways along which the inwardly projected pins can travel between a 'locking' (at the intersection portion) and 'open' (at the shielded portion) rotational positions.

Although in the examples shown herein the canted coil is arranged on the connector and the cam surface/circumferential groove is arranged on the mating connector it would be understood that the canted coil spring may be arranged on the mating connector and the cam surface arranged on the angled connector. Furthermore the canted coil spring could be replaced by a plurality of discrete spring elements spaced about the circumference of either connector.

A specific embodiment has been described above. Various changes and modifications may be made to the specific embodiment without departing from the invention.

What is claimed is:

1. An electrical connector for terminating an electrical cable and for engaging with a mating electrical connector, the connector comprising:

a body having an engagement portion including a sleeve which extends in a longitudinal first direction for engaging with the mating electrical connector, the sleeve further comprising at least one keyway configured to receive a keyed mating connector at a keyway opening;

at least one resilient member arranged on the sleeve of the engagement portion, the resilient member being capable of deforming in a transverse direction perpendicular to the first direction and providing a reaction force for maintaining the engagement of the connector with the mating connector; and a collar configured to be rotatable about at least the sleeve, wherein the collar comprises a radially inwardly protruding pin which extends into the sleeve and can be moved between two positions, one of the two positions being within the keyway between the key of the mating connector and the keyway opening such that the pin prevents axial disengagement of the connector.

2. The electrical connector as claimed in claim 1, wherein the other of the two positions being within the keyway shielded by the sleeve such that the pin is unable to engage with the key of the mating connector.

3. The electrical connector as claimed in claim 1, wherein the at least one keyway comprises a circumferential keyway portion configured to receive the radially protruding pin.

4. The electrical connector as claimed in claim 1, wherein the at least one keyway comprises an axial keyway portion extending from the keyway opening to a keyway axial stop.

5. The electrical connector as claimed in claim 4, wherein the at least one keyway comprises a circumferential keyway portion configured to receive the radially protruding pin; and wherein the axial keyway portion is intersected by the circumferential keyway portion between the axial keyway stop and the keyway opening such that the key of the keyed mating connector is configured to be located at the keyway axial stop when the electrical connector is fully engaged with the mating electrical connector and the pin prevents axial disengagement of the connector by being located on the axial keyway between the key of the keyed mating connector and the keyway opening.

6. The electrical connector as claimed in claim 1, comprising a detent device to mechanically latch the collar in at least one of the two positions.

7. The electrical connector as claimed in claim 6, wherein the detent device comprises at least one axially biased ball bearing located within the collar and configured to engage detents formed in the sleeve at angular positions corresponding to at least one of the two positions.

8. The electrical connector as claimed in claim 1, further comprising an o-ring located between the collar and sleeve and configured to provide rotational resistance.

9. The electrical connector as claimed in claim 1, wherein an alignment notch is provided at a location around the outside of the sleeve.

10. The electrical connector as claimed in claim 1, wherein the collar comprises a shaped outer surface suitable for engaging a spanner to assist rotation of the collar.

11. A first electrical connector for engaging with a second electrical connector, the first electrical connector comprising:

a projecting connection port, having electrical contacts within an end face of the port; and a protecting collar circumferentially around the connection port; and a key feature configured to interact with a keyway on the second electrical connector, an alignment feature configured to indicate a s position of the key feature;

wherein the first electrical connector is configured such that the key feature can engage with a radially inwardly protruding pin on the second electrical connector, wherein the pin is configured to rotate from a first position on a first circumferential side of the alignment feature to a second position on a second circumferential side of the alignment feature; and wherein, when the pin is rotated to the second position, the key feature is locked in the keyway, thereby inhibiting axial disengagement of the first and second electrical connectors.

12. The first electrical connector as claimed in claim 11, wherein the electrical contacts comprise recesses in the end face.

13. The first electrical connector as claimed in claim 11, wherein the electrical contacts comprise pads flush with the end face.

14. A connector arrangement, comprising:

a first electrical connector and a second electrical connector, the second electrical connector for mating with the first electrical connector, the first electrical connector comprising:

a body having an engagement portion including a sleeve which extends in a longitudinal first direction for engaging with the second electrical connector, the sleeve further comprising at least one keyway configured to receive a keyed mating connector at a keyway opening;

at least one resilient member arranged on the sleeve of the engagement portion, the resilient member being capable of deforming in a transverse direction perpendicular to the first direction and providing a reaction force for maintaining the engagement of the first electrical connector with the second electrical connector; and a collar configured to be rotatable about at least the sleeve, wherein the collar comprises a radially inwardly protruding pin which extends into the sleeve and can be moved between two positions, one of the two positions being within the keyway between the key of the second electrical connector and the keyway opening such that the pin prevents axial disengagement of the first electrical connector; and the second electrical connector comprising:

a projecting connection port, having electrical contacts within an end face of the port; and a protecting collar circumferentially around the connection port, with a key feature configured to interact with the keyway on the first electrical connector, wherein the first electrical connector comprises the radially inwardly protruding pin which when rotated to a position prevents axial disengagement of the second electrical connector by locking the key feature within the keyway.

15. The connector arrangement as claimed in claim 14, wherein with the first electrical connector, the other of the two positions being within the keyway shielded by the sleeve such that the pin is unable to engage with the key of the second electrical connector.

16. The connector arrangement as claimed in claim 14, further comprising a detent device in the first electrical connector to mechanically latch the collar in at least one of the two positions.

17. The connector arrangement as claimed in claim 14, further comprising an o-ring in the first electrical connector located between the collar and sleeve and configured to provide rotational resistance.

18. The connector arrangement as claimed in claim 14, wherein with the first electrical connector, the collar comprises a shaped outer surface suitable for engaging a spanner to assist rotation of the collar.

19. The connector arrangement as claimed in claim 14, wherein the electrical contacts in the second electrical connector comprise recesses in the end face.

20. The connector arrangement as claimed in claim 14, wherein the electrical contacts in the second electrical connector comprise pads flush with the end face.

* * * * *